US008523179B2

(12) United States Patent
Miyakoshi

(10) Patent No.: US 8,523,179 B2
(45) Date of Patent: Sep. 3, 2013

(54) DOCUMENT DEVICE AND IMAGE FORMING APPARATUS WITH OFFSET DRIVEN ROLLER

(75) Inventor: Naoto Miyakoshi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/412,486

(22) Filed: Mar. 5, 2012

(65) Prior Publication Data

US 2012/0228823 A1 Sep. 13, 2012

(30) Foreign Application Priority Data

Mar. 7, 2011 (JP) ..... 2011-049139

(51) Int. Cl.
*B65H 5/04* (2006.01)
*B65H 5/06* (2006.01)

(52) U.S. Cl.
CPC ..... *B65H 5/062* (2013.01)
USPC ..... 271/272; 271/274

(58) Field of Classification Search
USPC ..... 271/272, 273, 274
See application file for complete search history.

(56) References Cited

U.S. PATENT DOCUMENTS

| | | | | |
|---|---|---|---|---|
| 4,695,048 | A * | 9/1987 | Gorner et al. | 271/122 |
| 6,343,787 | B1 * | 2/2002 | Kato et al. | 271/274 |
| 7,735,828 | B2 | 6/2010 | Maeyama | |
| 2002/0195766 | A1 * | 12/2002 | Sekine | 271/34 |
| 2010/0123282 | A1 * | 5/2010 | Miyakoshi | 271/3.19 |
| 2011/0115148 | A1 * | 5/2011 | Nakaishi | 271/272 |

FOREIGN PATENT DOCUMENTS

| | | |
|---|---|---|
| JP | H02-135368 A | 5/1990 |
| JP | 2002-284388 | 10/2002 |
| JP | 2004-277055 A | 10/2004 |
| JP | 2009-202978 | 9/2009 |

* cited by examiner

*Primary Examiner* — Gerald McClain
(74) *Attorney, Agent, or Firm* — Knobbe Martens Olson & Bear LLP

(57) ABSTRACT

A document feeding device includes a document reader, a drive roller and a plurality of driven rollers. The document reader is configured to read a document fed in a feeding direction. The drive roller is disposed upstream of the document reader in the feeding direction. The plurality of driven rollers is disposed opposite to the drive roller to form nips therebetween. The plurality of driven rollers is supported by one common shaft extending in a direction orthogonal to the feeding direction. A position of at least one nip formed by at least one of the plurality of driven rollers is offset downstream or upstream of other nips formed by other driven rollers.

15 Claims, 9 Drawing Sheets

DOCUMENT DEVICE AND IMAGE FORMING APPARATUS WITH OFFSET DRIVEN ROLLER

INCORPORATION BY REFERENCE

This application is based on and claims the benefit of priority from Japanese Patent Application No. 2011-049139, filed on 7 Mar. 2011, the content of which is incorporated herein by reference.

BACKGROUND

The present disclosure relates to a document feeding device that conveys a document to a document reader, and an image forming apparatus provided with the document feeding device.

A document feeding device generally causes a document to be nipped at nips formed between a plurality of drive rollers disposed at predetermined intervals in a direction orthogonal to a feeding direction and a plurality of driven rollers disposed to face the drive rollers, respectively, feeding the document to a document reader through the rotation driven by the drive rollers. If the nips formed between a plurality of facing pairs of rollers are aligned in a direction orthogonal to the feeding direction, a rear end of the fed document will be released from the nips simultaneously or substantially simultaneously, when the document is fed by such a document feeding device. Since a feeding load drastically changes (reduces) at the moment of the rear end of the document being released from the nips, a feeding speed of the document temporarily accelerates. This may affect the feeding speed of the document in the document reader, leading to defective reading.

In order to reduce such change in the feeding load, a document feeding device has been conventionally proposed in which nips are formed not in line with each other in a direction orthogonal to a feeding direction. This is implemented by arranging respective rotational shafts of a plurality of rollers, either a plurality of drive rollers or a plurality of driven rollers, offset with respect to the feeding direction.

SUMMARY

However, the conventional document feeding device requires that the rotational shafts of the plurality of rollers and supporting members for supporting the rotational shafts be independently provided. This may lead to an increase in the number of parts, rendering the structure and assembly of an apparatus to be complex, and an increase in cost. In addition, as the plurality of rollers needs to be assembled individually, a problem arises in that variations may tend to occur in accuracies of positions of the rollers and distances (dimensions) therebetween, which may prevent stable feeding of a document.

The present disclosure provides a document feeding device that realizes stable feeding of documents by suppressing sudden change in the feeding load with a simple structure of a reduced number of parts.

The present disclosure also provides an image forming apparatus provided with such a document feeding device.

The present disclosure relates to a document feeding device, which includes a document reader, a drive roller and a plurality of driven rollers. The document reader is configured to read a document fed in a feeding direction. The drive roller is disposed upstream of the document reader in the feeding direction. The plurality of driven rollers is disposed opposite to the drive roller to form nips therebetween. The plurality of driven rollers is supported by one common shaft extending in a direction orthogonal to the feeding direction. A position of at least one nip formed by at least one of the plurality of driven rollers is offset downstream or upstream of other nips formed by other driven rollers.

The present disclosure also relates to an image forming apparatus, which includes the document feeding device described above and an image forming unit. The image forming unit is configured to form an image on an image recording medium shaped like a sheet based on image information acquired by the document reader in reading a document.

DETAILED DESCRIPTION

Figure 1:
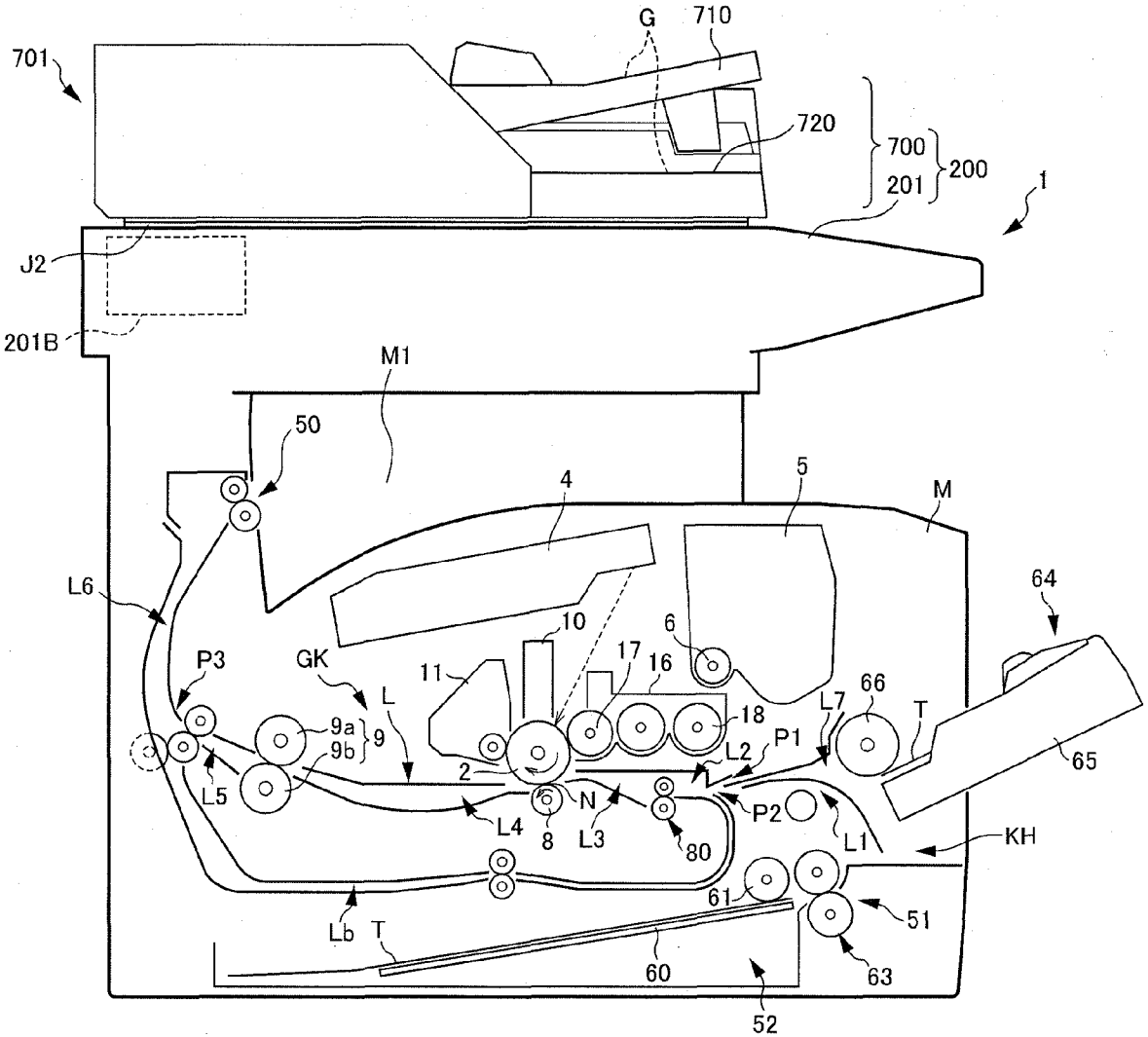
FIG. 1 is a left side view illustrating an arrangement of respective components of a copy machine 1 as an embodiment of an image forming apparatus of the present disclosure.
Figure 2:
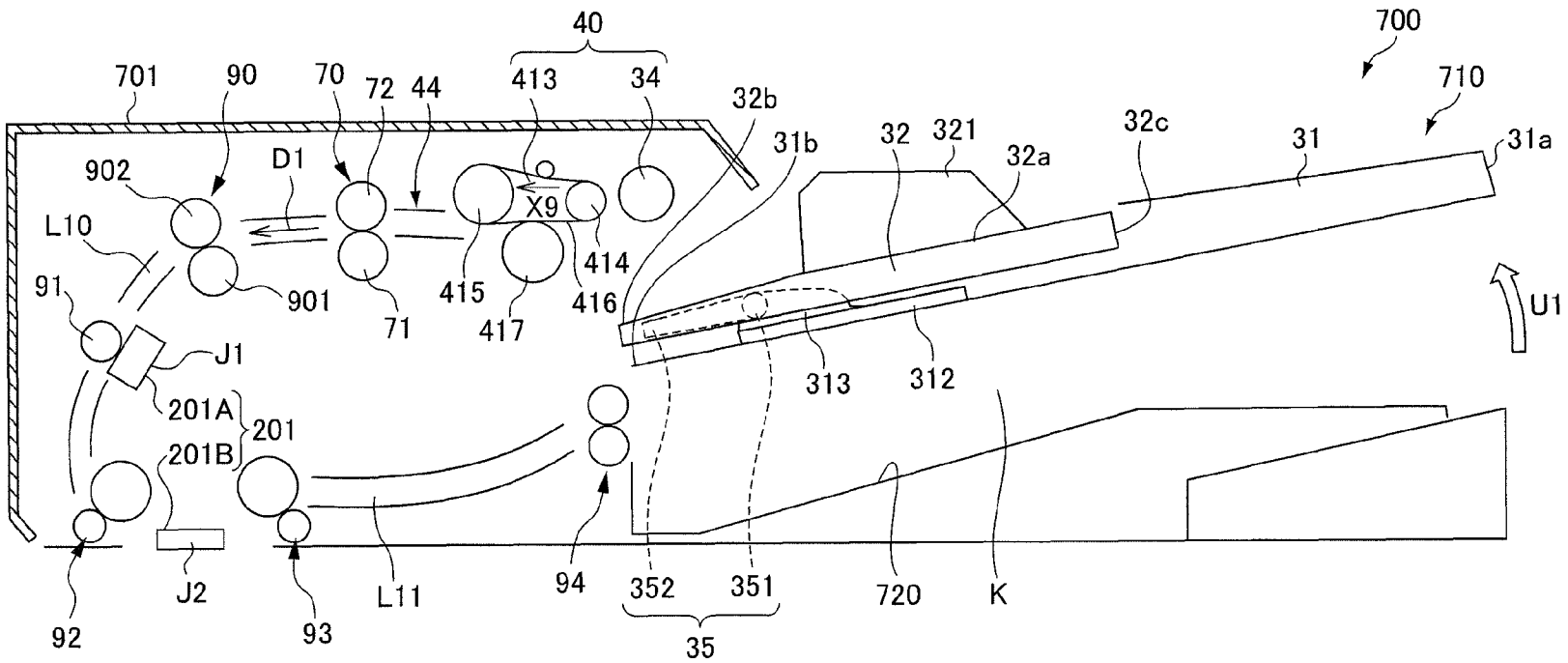
FIG. 2 is a schematic view illustrating a positional relationship between a document feeding mechanism 44 and a document lifting member 32 in a state in which a downstream end of the document lifting member 32 is lowered in the document feeding device 700 shown in FIG. 1.
Figure 3:
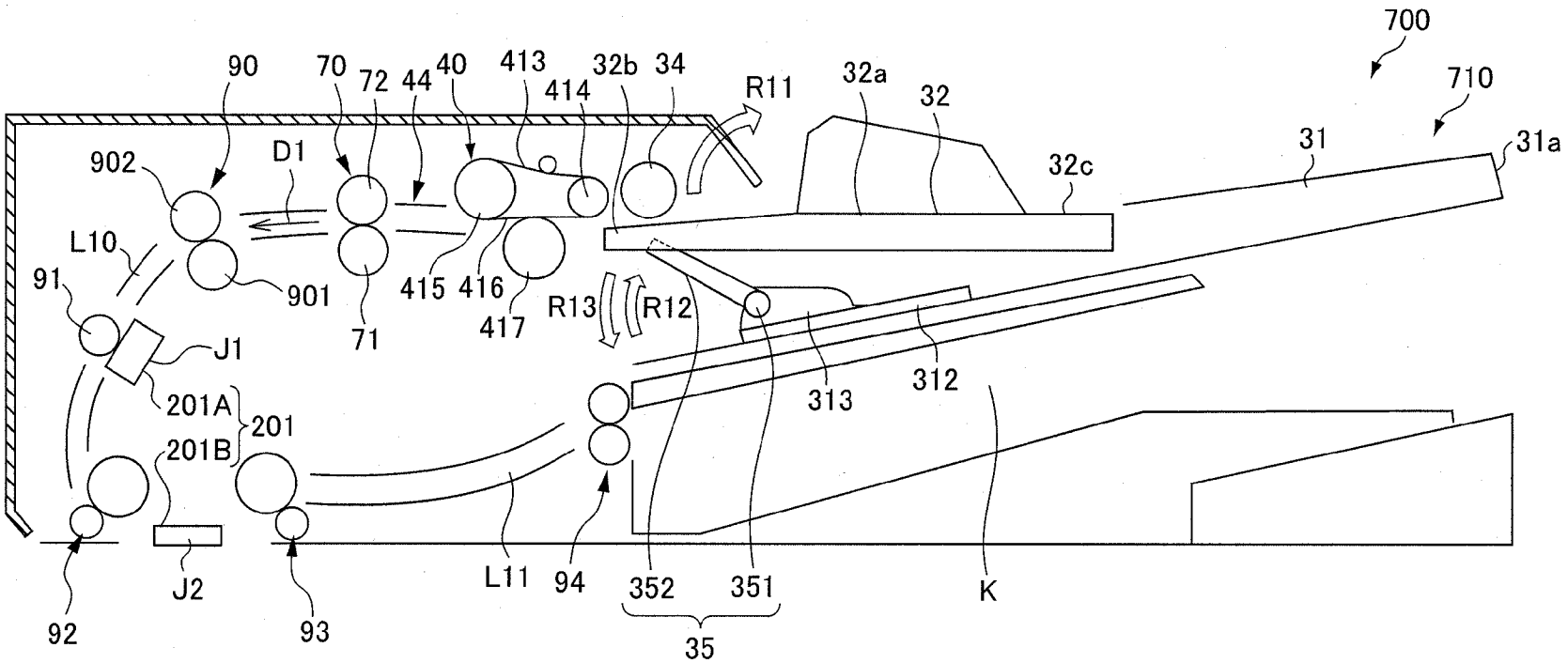
FIG. 3 is a schematic view illustrating a positional relationship between the document feeding mechanism 44 and the document lifting member 32 in a state in which the downstream end of the document lifting member 32 is raised in the document feeding device 700 shown in FIG. 1.

An embodiment of the present disclosure will be described hereinafter with reference to the drawings. First, the overall structure of a copy machine 1 as an embodiment of an image forming apparatus according to the present disclosure will be described with reference to FIGS. 1 to 3. FIG. 1 is a left side view illustrating an arrangement of respective components of the copy machine 1 as an embodiment of an image forming apparatus of the present disclosure. FIG. 2 is a schematic view illustrating a positional relationship between a document feeding mechanism 44 and a document lifting member 32 in a state in which a downstream end of the document lifting member 32 is lowered in a document feeding device 700 shown in FIG. 1. FIG. 3 is a schematic view illustrating a positional relationship between the document feeding mechanism 44 and the document lifting member 32 in a state in which the downstream end of the document lifting member 32 is raised in the document feeding device 700 shown in FIG. 1.

As shown in FIG. 1, the copy machine 1 according to the present embodiment includes a document reading device 200 and an apparatus main body M. The document reading device 200 includes a document reader 201 and a document feeding device 700. The document feeding device 700 is disposed perpendicularly above the document reader 201 and automatically feeds a document G to the document reader 201. The apparatus main body M is disposed perpendicularly below the document reading device 200 and forms a toner image on a sheet of paper T (recording medium shaped like a sheet) based on image information of the document G read by the document reader 201.

First, the document feeding device 700 will be briefly described. Thereafter, the document reader 201 of the document reading device 200 and the apparatus main body M will be described, and finally the document feeding device 700 will be described in detail. As illustrated in FIGS. 1 to 3, the document feeding device 700 includes a feeding mechanism housing 701, a document placement portion 710, and a document collecting portion 720.

The feeding mechanism housing 701 houses a feed roller unit 40 (described later) and a document feeding mechanism 44 (described later) in the document feeding device 700. The document placement portion 710 is where documents G are stacked, images of which are to be read. The document collecting portion 720 is disposed perpendicularly below the document placement portion 710, and collects documents G having passed predetermined document reading points J1, J2 (described later).

As shown in FIGS. 2 and 3, the document feeding device 700 of the present embodiment sequentially feeds the documents G placed on the document placement portion 710 to the first document reading point J1 lying upstream in a feeding direction D1 and the second document reading point J2 lying downstream by means of the document feeding mechanism 44 provided inside the feeding mechanism housing 701. The document feeding device 700 of the present embodiment discharges a document G on which an image reading process has been completed by the document reader 201 to a document discharging space K.

The detailed configuration of the document placement portion 710, and the configuration of the feed roller unit 40 and the document feeding mechanism 44 inside the feeding mechanism housing 701 will be described after explanation of the apparatus main body M.

Next, the document reader 201 will be described. As shown in FIGS. 2 and 3, the document reader 201 includes a first reading unit 201A which is composed of a contact image sensor (CIS), and a second reading unit 201B. The first reading unit 201A is disposed at the first document reading point J1 lying upstream in the feeding direction D1 of the document feeding mechanism 44, and reads image information on a back face of a document G. The second reading unit 201B is disposed at the second document reading point J2 lying downstream in the feeding direction D1, and reads image information on a front face of the document G. The second reading unit 201B lying downstream in the feeding direction D1 includes an illumination unit including a light source, a plurality of mirrors forming light paths, an imaging lens, a CCD, and a CCD board.

The document reader 201 is configured to read the image information of front and back faces of the document G by the first reading unit 201A and the second reading unit 201B without turning over the document G and to perform a predetermined process on the read image information of the front and back faces of the document G. Also the document reader 201 is configured to output the image information thus processed to an image forming unit GK in the apparatus main body M.

Next, the apparatus main body M will be described. As illustrated in FIG. 1, the apparatus main body M includes the image forming unit GK that forms an image on a sheet of paper T based on the image information sent from the document reader 201, and a paper feeding/discharging unit KH that supplies a sheet of paper T to the image forming unit GK and discharges the sheet of paper T with an image formed thereon.

As illustrated in FIG. 1, the image forming unit GK includes a photoreceptor drum 2, a charging unit 10, a laser scanner unit 4, a developing unit 16, a toner cartridge 5, a toner supply device 6, a drum cleaning device 11, a transfer roller 8, and a fixing device 9.

The paper feeding/discharging unit KH includes a paper feeding cassette 52, a manual feeding portion 64, a pair of registration rollers 80, and a feeding path L for a sheet of paper T.

The photoreceptor drum 2 is composed of a cylindrical member, and functions as an image bearing member. The photoreceptor drum 2 is disposed rotatably about an axis perpendicular to a paper surface of FIG. 1 in the apparatus main body M. An electrostatic latent image is formed on a surface of the photoreceptor drum 2.

The charging unit 10 is disposed on a vertically upper side (upward) of the photoreceptor drum 2. The charging unit 10 positively charges (in a positive polarity) the surface of the photoreceptor drum 2 uniformly.

The laser scanner unit 4 is spaced away from the photoreceptor drum 2 on a vertically upper side (upward) of the photoreceptor drum 2. The laser scanner unit 4 includes a laser light source, a polygon mirror, a polygon mirror driving motor and the like, which are not illustrated.

The laser scanner unit 4 scans and exposes the surface of the photoreceptor drum 2 based on image information output by the image reading device 200. By being scanned and exposed by the laser scanner unit 4, an electric charge charged onto the surface of the photoreceptor drum 2 is removed. In this way, an electrostatic latent image is formed on a surface of the photoreceptor drum 2.

The developing unit 16 is disposed in front of the photoreceptor drum 2 (on the right side of FIG. 1). The developing unit 16 develops a single color (usually black) toner image on the electrostatic latent image formed on the photoreceptor drum 2. The developing unit 16 includes a developing roller 17 that can be disposed facing the photoreceptor drum 2, and a stirring roller 18 for stirring toner.

The toner cartridge 5 contains toner that is to be supplied to the developing unit 16. The toner feeding device 6 supplies the toner stored in the toner cartridge 5 to the developing unit 16.

The drum cleaning device 11 is disposed behind the photoreceptor drum 2 (on the left side as shown in FIG. 1). The drum cleaning device 11 removes remaining toner and attached matters on the surface of the photoreceptor drum 2.

The transfer roller 8 causes a toner image developed on the surface of the photoreceptor drum 2 to be directly transferred to a sheet of paper T. A voltage application means (not illustrated) applies a transfer bias to the transfer roller 8, the bias being for transferring the toner image developed on the photoreceptor drum 2 to the sheet of paper T. The toner image developed on the surface of the photoreceptor drum 2 can be transferred to the sheet of paper T indirectly through an intermediate transfer belt or the like.

The transfer roller 8 is configured to be movable between a contact position and a separated position. That is to say, the transfer roller 8 is in contact with or spaced away from the photoreceptor drum 2 at the contact position or the separated position, respectively. In particular, the transfer roller 8 is moved to the contact position for transferring the toner image developed on the photoreceptor drum 2 to the sheet of paper T, and to the separated position in all other circumstances. The sheet of paper T is sandwiched by the photoreceptor drum 2 and the transfer roller 8, and is pressed onto the surface of the photoreceptor drum 2 (a side on which the toner image is developed). A transfer nip N for transferring an image is thus formed and the toner image developed on the photoreceptor drum 2 is transferred to the sheet of paper T.

The fixing device 9 fuses toner and fixes the toner image transferred to the sheet of paper T. The fixing device 9 includes a heating roller 9*a* heated by a heater, and a pressurizing roller 9*b* in pressure contact with the heating roller 9*a*. The heating roller 9*a* and the pressurizing roller 9*b* sandwich and convey the sheet of paper T onto which the toner image has been transferred. As the sheet of paper T is conveyed while being sandwiched between the heating roller 9*a* and the pressurizing roller 9*b*, the toner transferred to the sheet of paper T is fused and fixed.

The paper feeding cassette 52 is disposed in a lower portion (lower side in a vertical direction) in the apparatus main body M. The paper feeding cassette 52 is disposed horizontally slidable toward a front side (the right side in FIG. 1) of the apparatus main body M. The paper feeding cassette 52 includes a placing board 60 on which sheets of paper T are placed. The sheets of paper T stacked on the placing board 60 are stored in the paper feeding cassette 52. A cassette feeding portion 51 is disposed in an end portion of the paper feeding cassette 52 on a side of discharging a sheet of paper T (in a right end portion of FIG. 1). The cassette feeding portion 51 feeds out the sheets of paper T stored in the paper feeding cassette 52 to a paper path L.

The cassette feeding portion 51 includes a double feed preventing mechanism composed of a forward feed roller 61 for picking up the sheets of paper T placed on the placing board 60 and a pair of rollers 63 for feeding the sheets of paper T one sheet at a time to the paper path L.

The paper path L for feeding a sheet of paper T is formed between a discharge portion 50 and the cassette feeding portion 51 or the manual feeding portion 64. The paper path L includes a first feeding path L1 from the cassette feeding portion 51 to a first junction P1, a second feeding path L2 from the first junction P1 to the pair of registration rollers 80, a third feeding path L3 from the pair of registration rollers 80 to the transfer roller 8, a fourth feeding path L4 from the transfer roller 8 to the fixing device 9, a fifth feeding path L5 from the fixing device 9 to a branch portion P3, and a sixth feeding path L6 from the branch portion P3 to the discharge portion 50.

The paper path L further includes a seventh feeding path L7 from the manual feeding portion 64 to the first junction P1. The first junction P1 is where the first feeding path L1 for feeding a sheet of paper T from the cassette feeding portion 51 merges with the seventh feeding path L7 for feeding a sheet of paper T from the manual feeding tray 65. A second junction P2 is provided midway in the second feeding path L2. In addition, the paper path L has a return feeding path Lb from the branch portion P3 to the second junction P2. The second junction P2 is where the second feeding path L2 merges with the return feeding path Lb.

Here, the pair of registration rollers 80 is disposed upstream of the transfer roller 8, in a direction feeding a sheet of paper T (the right side in FIG. 1). The pair of registration rollers 80 performs skew correction of a sheet of paper T and timing adjustment with respect to a toner image.

The return feeding path Lb is provided for causing a surface of a sheet of paper T (unprinted surface) opposite to a surface that has been already printed to face the photoreceptor drum 2 when duplex printing of the sheet of paper T is performed. The return feeding path Lb can reverse and return the sheet of paper T, conveyed from the branch portion P3 toward the paper discharge portion 50, to the second feeding path L2. A toner image is transferred by the photoreceptor drum 2 to the unprinted surface of the sheet of paper T that is reversed by the return feeding path Lb.

The manual feeding portion 64 is provided in front (the right side in FIG. 1) of the apparatus main body M, above the feeding cassette 52. The manual feeding portion 64 feeds a sheet of paper T placed on the open manual feeding tray 65 to the second feeding path L2 via the seventh feeding path L7 and the first junction P1. The manual feeding portion 64 includes the manual feeding tray 65 and a feeding roller 66. A base end portion of the manual feeding tray 65 is rotatably (openably and closably) connected in the vicinity of an entrance to the seventh feeding path L7. The manual feeding tray 65 makes a portion of a front surface of the apparatus main body M when the manual feeding tray 65 is closed. The feeding roller 66 picks up a sheet of paper T placed on the manual feeding tray 65 and feeds it toward the seventh feeding path L7.

The paper discharge portion 50 is formed at an end of the sixth feeding path L6. The paper discharge portion 50 is disposed in an upper portion of the apparatus main body M. The paper discharge portion 50 has an opening toward a front of the apparatus main body M (right side in FIG. 1). The paper discharge portion 50 discharges a sheet of paper T, on which the toner is fixed by the fixing device 9, to the outside of the apparatus main body M.

A discharged paper collecting portion M1 is provided on a side of an open port of the paper discharge portion 50. The discharged paper collecting portion M1 is provided on an upper face (outer face) of the apparatus main body M. The discharged paper collecting portion M1 is where the upper surface of the apparatus main body M is recessed (vertically downward). A bottom face of the discharged paper collecting portion M1 constitutes a part of the upper face of the apparatus main body M. Sheets of paper T discharged from the discharge portion 50, to which images have been transferred, are stacked and collected at the discharged paper collecting portion M1.

The image information delivered by the document reader 201 is sent to the apparatus main body M through the document reading device 200. The image information received by the apparatus main body M is sent to an image forming control unit (not illustrated). Based on the image information, the image forming control unit controls the photoreceptor drum 2 as an image bearing member, the charging unit 10, the laser scanner unit 4, the developing unit 16, and the like, which compose the image forming unit GK, respectively. A predetermined toner image is formed on the photoreceptor drum 2 based on the image information.

Based on the image information, an image equivalent to the image of a document G is transferred to a sheet of paper T, which is conveyed to the transfer nip N formed by the photoreceptor drum 2. The sheet of paper T, on which the image is formed, is discharged from the paper discharge portion 50 to the discharged paper collecting portion M1.

Next, the document placement portion 710 of the document feeding device 700 and the document feeding mechanism 44 in the feeding mechanism housing 701 of the present embodiment are described with reference to FIGS. 2 and 3. First, the schematic configuration of the document feeding device 700 is described with reference to FIGS. 2 and 3.

The document feeding device 700 of the present embodiment includes, as shown in FIGS. 2 and 3, a document mounting part 31, a document lifting member 32, a lift operating member 35, a feeding roller unit 40, a document feeding mechanism 44, and a motor (not illustrated). The feeding roller unit 40 is composed of a pickup roller 34 and a belt-type feeding means 413.

The document mounting part 31 is a tray that constitutes a main part of the document placement portion 710, on which a document G to be fed is placed. A downstream end 31*b* of the document mounting part 31 is rotatably connected to the feeding mechanism housing 701 such that an upstream end 31*a* thereof is movable upward as indicated by an arrow U1 in FIG. 2.

Operation to move upward the upstream end 31*a* of the document mounting part 31 is necessary for facilitating troubleshooting of a paper jam occurring in the document discharging space K, for example, which is positioned below the document mounting part 31.

As shown in FIGS. 2 and 3, the document lifting member 32 is attached to an upper face at a downstream portion of the document mounting part 31 so as to be positioned on a lower face at a downstream portion of a document G placed on the document mounting part 31. An upper face 32*a* of the document lifting member 32 serves as a placement face on which a downstream portion of the document G is placed, which is on the document mounting part 31.

The document lifting member 32 includes a pair of movable side walls 321 that restricts in a width direction the positions of both sides of the document G placed thereon (only one of the movable side walls is illustrated in FIGS. 2 and 3). The pair of movable side walls 321 is movable to be spaced apart from each other or to approach each other, thereby allowing positioning of both ends of various sizes of documents G.

In response to an upward rotational operation of the lift operating member 35, the document lifting member 32 rotates to lift the downstream end 32*b* as shown in FIG. 3. This lifts the downstream end of a document G placed on the document mounting part 31 and the document lifting member 32. On the other hand, in response to a downward rotational operation of the lift operating member 35, the document lifting member 32 rotates to lower the downstream end 32*b* as shown in FIG. 2. This lowers the downstream end of the document G placed on the document mounting part 31 and the document lifting member 32. FIG. 2 shows the document lifting member 32 that is lowered to the lowest position.

Although not illustrated, the document lifting member 32 rotatably engages with the document mounting part 31 at the upstream end 32*c*. In response to an upward rotational operation of the lift operating member 35, the document lifting member 32 rotates about the upstream end 32*c* to cause the downstream end 32*b* to move upward, as indicated by an arrow R11 in FIG. 3. This rotational movement is referred to as "forward rotational movement" and another rotational movement in the opposite direction is referred to as "reverse rotational movement."

In other words, the document lifting member 32 lifts in response to the forward rotational movement and lowers in response to the reverse rotational movement.

The pickup roller 34 is arranged opposite to the upper face of the document lifting member 32, as shown in FIGS. 2 and 3. When the downstream end 32*b* of the document lifting member 32 is lifted by the lift operating member 35 and a document G is lifted by the document lifting member 32, the pickup roller 34 comes into contact with an upper face of the document G placed on the document lifting member 32. The pickup roller 34 in contact with the upper face of the document G rotates, so that it is possible to feed the document G from the document lifting member 32 to the document feeding mechanism 44 in the feeding mechanism housing 701. The pickup roller 34 is composed of a hollow rubber tube.

As shown in FIGS. 2 and 3, the feeding roller unit 40, the document feeding mechanism 44 and the like are provided in the feeding mechanism housing 701. The pickup roller 34 is disposed inside the feeding roller unit 40. The document feeding mechanism 44 discharges the document G, which is fed by the feeding roller unit 40, to the document discharging space K via the first document reading point J1 and the second document reading point J2. Configurations of the feed roller unit 40 and the document feeding mechanism 44 inside the feeding mechanism housing 701 are described later.

As shown in FIGS. 2 and 3, the lift operating member 35 includes a first rotational shaft member 351 and a lifting member 352. The first rotational shaft member 351 extends in the width direction of the document G. Both ends of the first rotational shaft member 351 are rotatably supported by a bearing portion 313 provided on a bottom wall 312 of the document mounting part 31.

The lifting member 352 is disposed below the document lifting member 32. A base end of the lifting member 352 is connected to the first rotational shaft member 351 and rotates about an axial center of the first rotational shaft member 351. The lifting member 352 is fixed to two points separated in an axial direction of the first rotational shaft member 351. In a case of the forward rotational movement (rotational movement in the direction of the arrow R12 in FIG. 3), the lifting member 352 rotates to lift the downstream end 32*b* of the document lifting member 32. On the other hand, in a case of the reverse rotational movement (rotational movement in the direction of the arrow R13 in FIG. 3), the lifting member 352 rotates to lower the downstream end 32*b* of the document lifting member 32.

In other words, in a case of the forward rotational movement (rotational movement in the direction of the arrow R12 in FIG. 3), the lifting member 352 operates to lift the document lifting member 32. On the other hand, in a case of the reverse rotational movement (rotational movement in a direction of an arrow R13 in FIG. 3), the lifting member 352 operates to lower the document lifting member 32.

In the present embodiment, as shown in FIGS. 2 and 3, the belt-type feeding means 413 is supported more downstream than the pickup roller 34. The belt-type feeding means 413 includes a pair of rollers 414, 415 disposed separated from each other in the feeding direction of a document G, a feeding belt 416 stretched around these rollers, and a pressing roller 417 that is pressed against the feeding belt 416 from below. The belt-type feeding means 413 feeds downstream a document G by driving the feeding belt 416 in the direction indicated by an arrow X9 in FIG. 2, while the feeding belt 416 and the pressing roller 417 sandwich the document G.

The document feeding mechanism 44 has a feeding path L10 for reading a document and a feeding path L11 for discharging a document inside the feeding mechanism housing 701. The feeding path L10 for reading a document feeds a document G from the feeding roller unit 40 to the second reading unit 201B (the second document reading point J2) via the first reading unit 201A (the first document reading point J1) of the document reader 201. The feeding path L11 for discharging a document feeds the document G having undergone a reading process from the second reading unit 201B (the second document reading point J2) to the document collecting portion 720.

In the feeding path L10 for reading a document, a pair of registration rollers 70 composed of a first registration roller 71 and a second registration roller 72, a pair of first feeding rollers 90, a CIS roller 91 facing the first reading unit 201A, and a pair of second feeding rollers 92 are provided along the feeding direction D1. In the feeding path L11 for discharging a document, a pair of third feeding rollers 93 and a pair of discharging rollers 94 are provided along the feeding direction D1.

Figure 4:
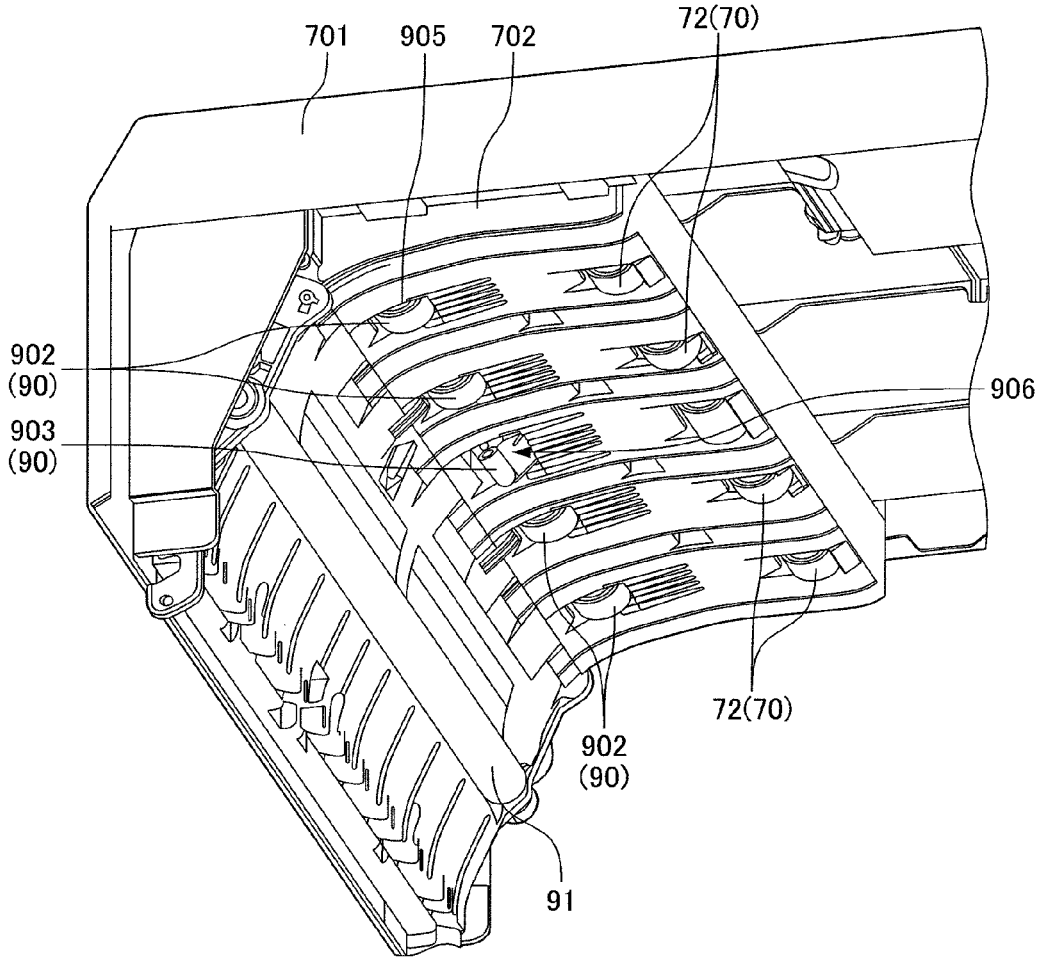
FIG. 4 is a perspective view of respective roller groups arranged along a feeding path L10 for reading a document, when viewed from inside a feeding mechanism housing 701.
Figure 5:
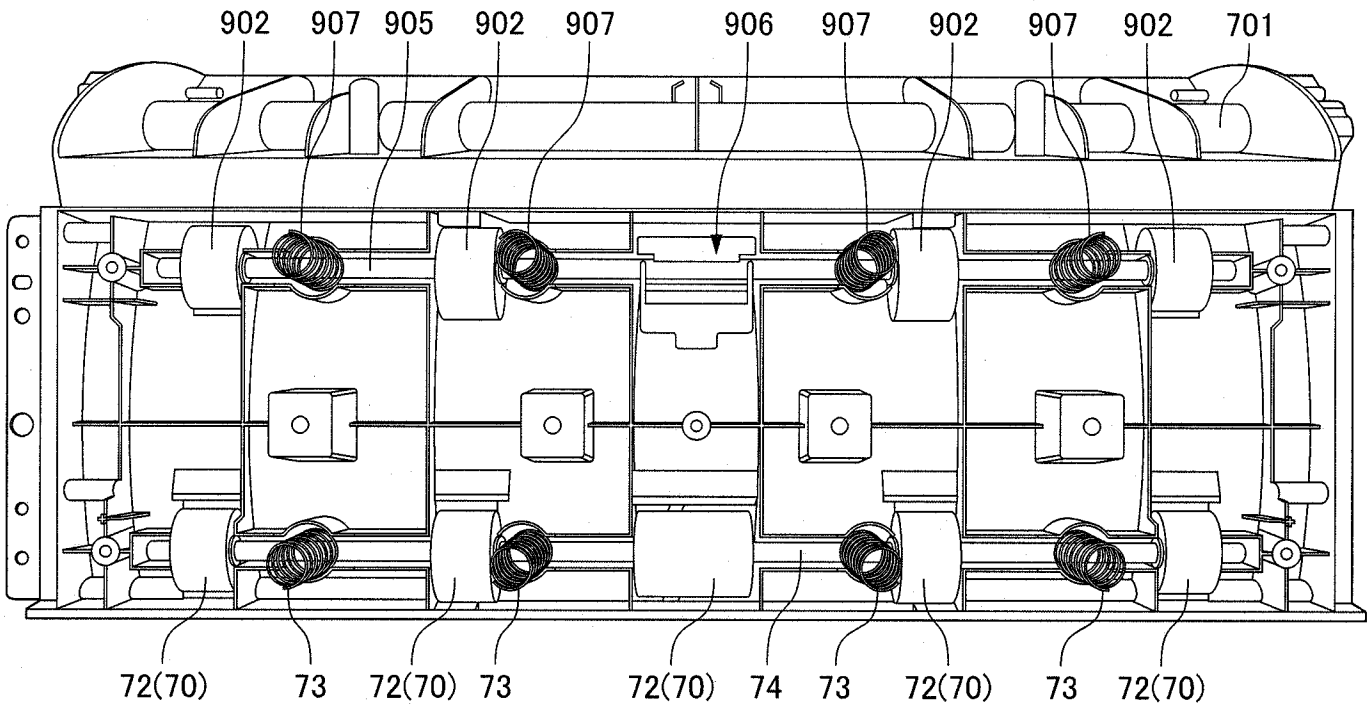
FIG. 5 is a plan view illustrating an overall configuration of a pair of registration rollers 70 and a pair of first feeding rollers 90 in a state in which a cover member 702 is removed.
Figure 6:
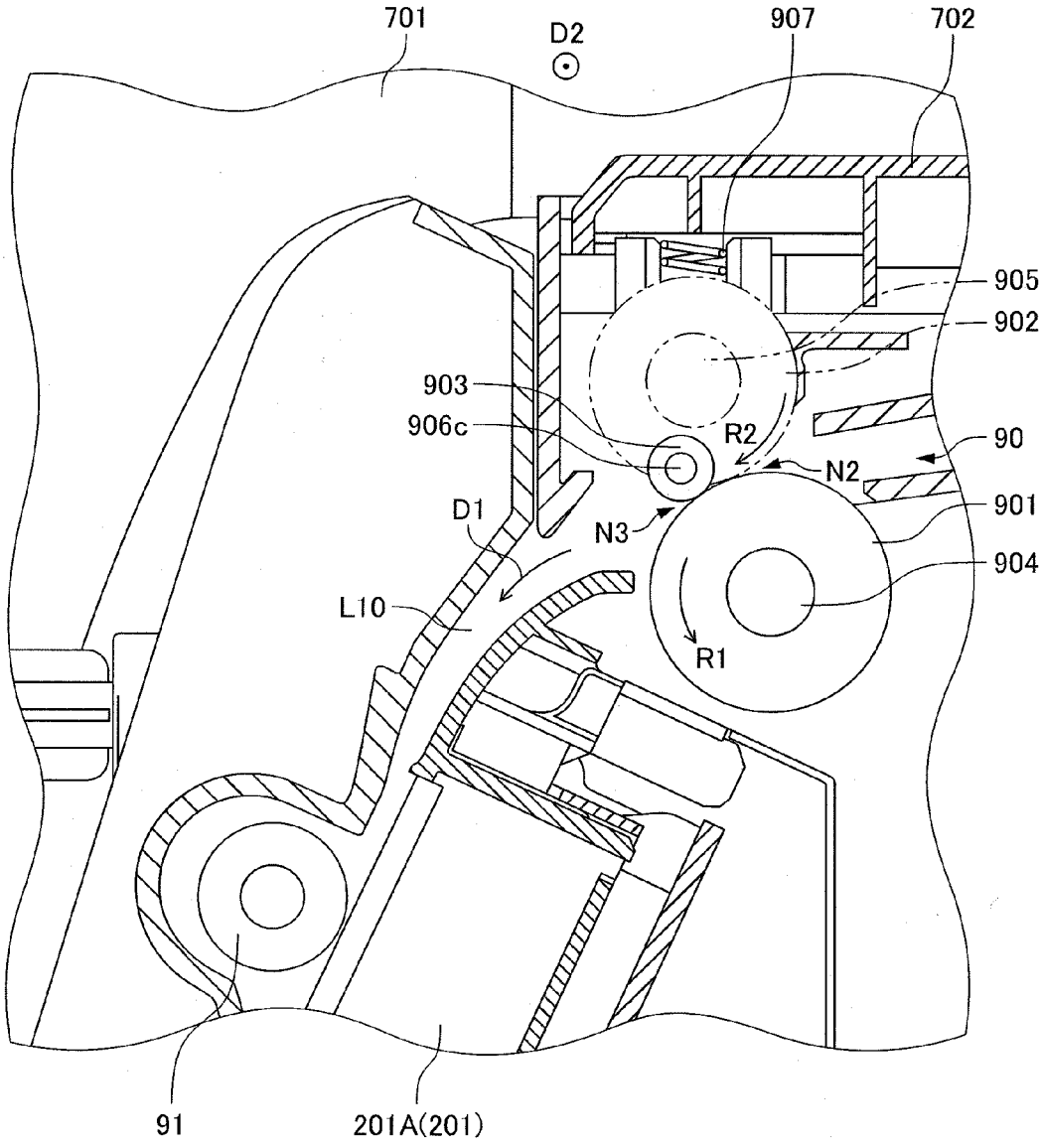
FIG. 6 is an enlarged cross-sectional view illustrating the vicinity of the pair of first feeding rollers 90.
Figure 7:
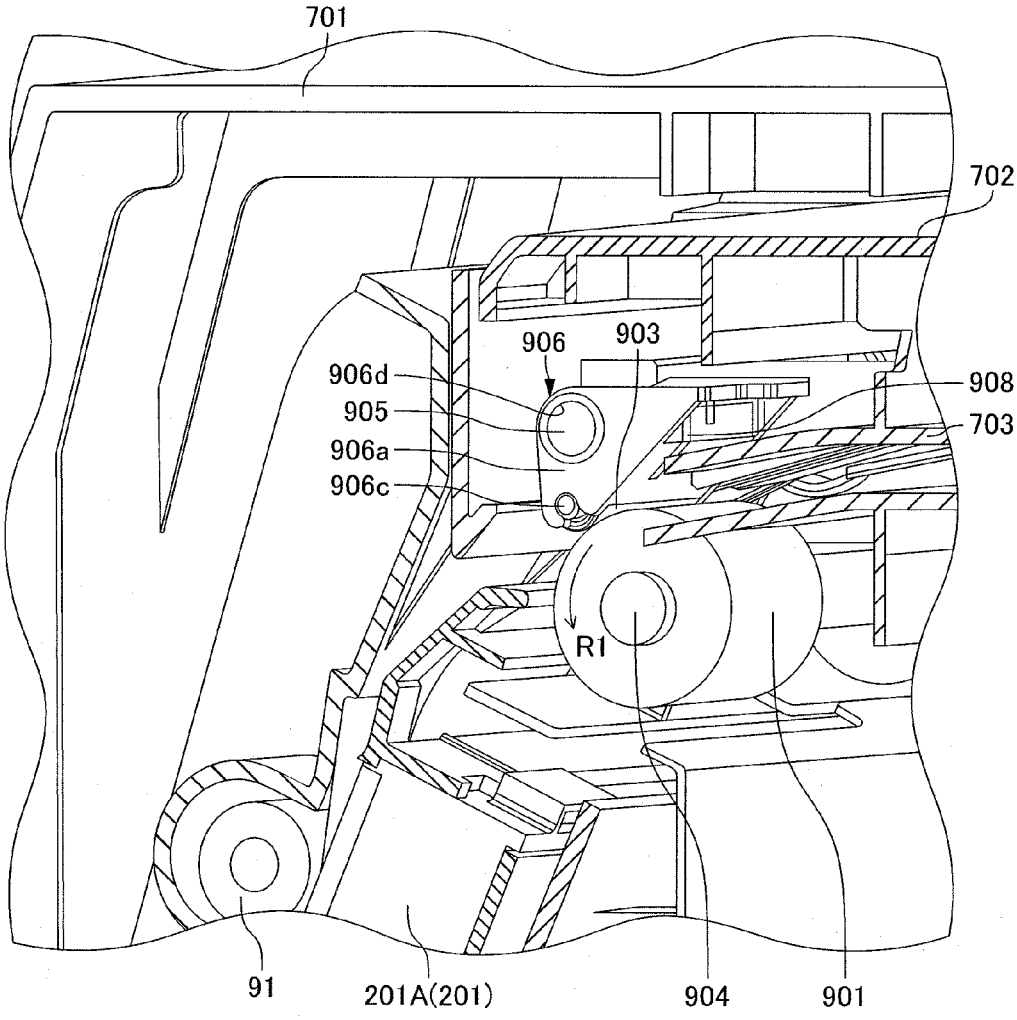
FIG. 7 is an enlarged perspective view illustrating the vicinity of the pair of first feeding rollers 90.
Figure 8:
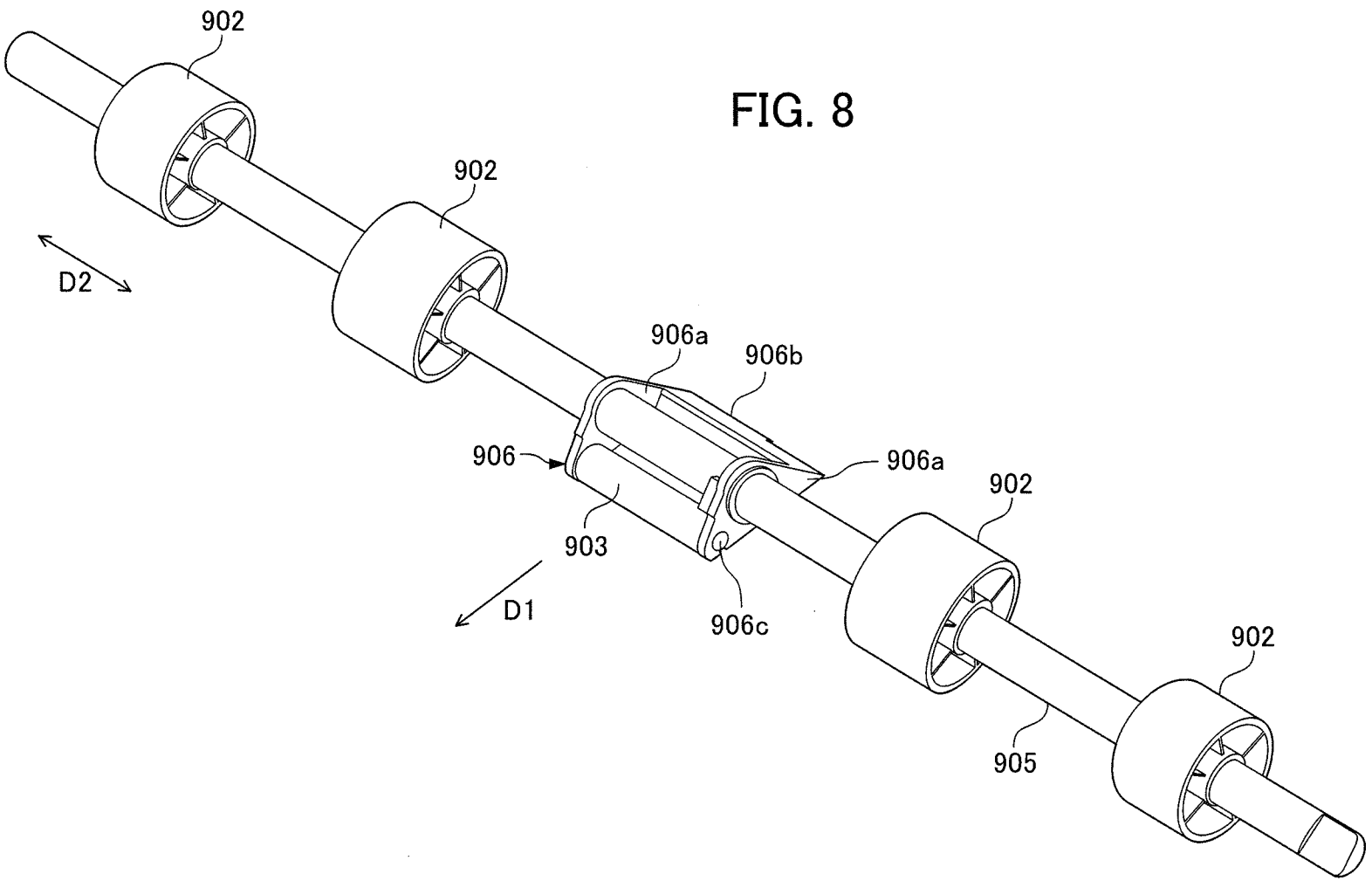
FIG. 8 is an overall perspective view illustrating driven rollers 902 and a central driven roller 903 of the pair of first feeding rollers 90.
Figure 9:
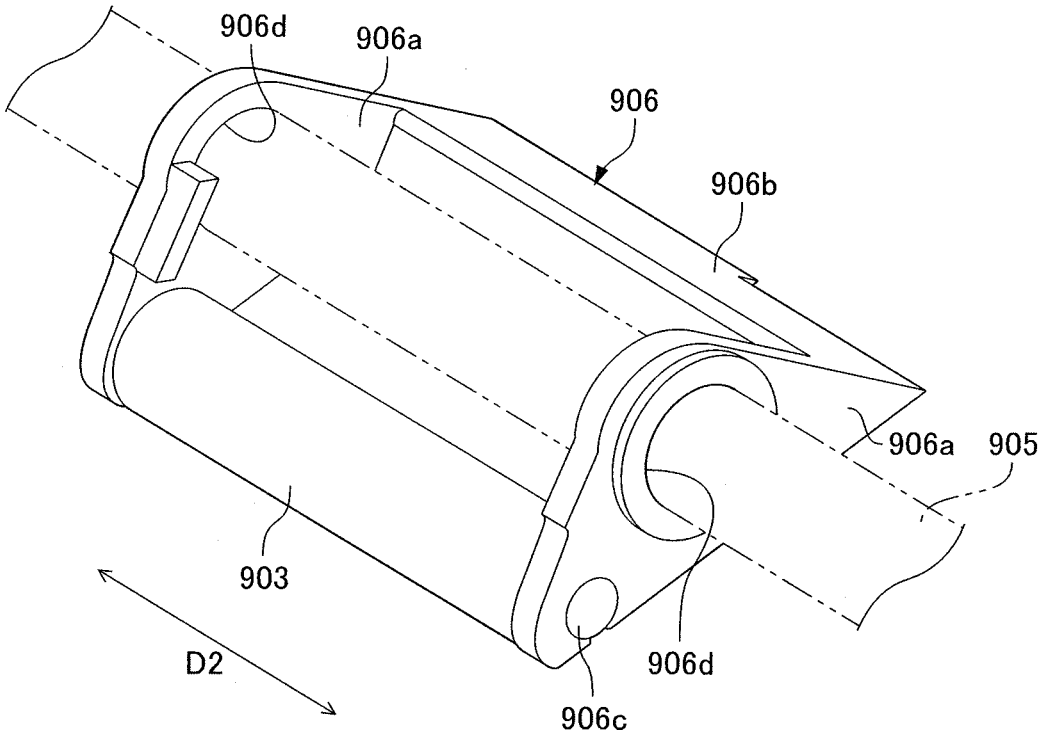
FIG. 9 is a perspective view illustrating a detailed configuration of the central driven roller 903.

Next, the document feeding mechanism 44, which is a characterizing feature of the document feeding device 700 of the copy machine 1 according to the present embodiment, is described in detail with reference to FIGS. 4 to 9. FIG. 4 is a perspective view illustrating respective roller groups arranged along the feeding path L10 for reading a document, when viewed from inside the feeding mechanism housing 701. FIG. 5 is a plan view illustrating an overall configuration of the pair of registration rollers 70 and the pair of first feeding rollers 90 in a state in which a cover member 702 is removed. FIG. 6 is an enlarged cross-sectional view illustrating the vicinity of the pair of first feeding rollers 90. FIG. 7 is an enlarged perspective view illustrating the vicinity of the pair of first feeding rollers 90. FIG. 8 is an overall perspective view illustrating driven rollers 902 and a central driven roller 903 of the pair of first feeding rollers 90. FIG. 9 is a perspective view illustrating a detailed configuration of the central driven roller 903.

As shown in FIGS. 4 to 9, upper portions of the pair of registration rollers 70 and the pair of first feeding rollers 90 are covered by the cover member 702 detachably installed inside the feeding mechanism housing 701. The pair of first feeding rollers 90, which is positioned upstream of the first reading unit 201A in the feeding direction D1, includes a plurality (five) of drive rollers 901 that are arranged at predetermined intervals in a direction D2 orthogonal to the feeding direction D1 and a plurality (five) of driven rollers 902 and 903 arranged opposite to the drive rollers 901. Between each drive roller 901 and each driven roller 902, a nip N2 (see FIG. 6) is formed. Between a center drive roller 901 and a center driven roller 903, which is an offset driven roller, a nip N3 (see FIG. 6) is formed.

The five drive rollers 901 are fixed to one drive shaft 904 extending in the direction D2 orthogonal to the feeding direction D1. An end of the drive shaft 904 projects outside a side portion of the feeding mechanism housing 701 and is connected to a motor (not illustrated). As the motor drives the drive shaft 904, the five drive rollers 901 are rotationally driven in the direction of the arrow R1 shown in FIGS. 6 and 7.

As shown in FIG. 8, the drive rollers 901 rotationally drive the five driven rollers 902 and 903 to rotate in a direction of an arrow R2 shown in FIG. 6. Among the five driven rollers 902 and 903, the center driven roller 903 arranged at a central position in the direction D2 orthogonal to the feeding direction D1 is designed to be smaller in diameter and greater in length than other four driven rollers 902.

The four driven rollers 902 except for the center driven roller 903 are rotatably supported concentrically about one common shaft 905 extending in the direction D2 orthogonal to the feeding direction D1. The common shaft 905 is biased downward by a plurality of coil springs 907 provided between the cover member 702 and the common shaft 905. In this manner, the four driven rollers 902 are elastically pressed against peripheral surfaces of the corresponding four drive rollers 901, respectively, thereby forming linear nips N2.

On the other hand, the center driven roller 903 is rotatably supported by a supporting member 906 that is positioned about the penetrating common shaft 905 at a central position in an axial direction thereof. As shown in FIG. 9, the supporting member 906 includes two side plates 906*a* in a substantially isosceles triangle shape, a connecting plate 906*b* that connects the two side plates 906*a* at first corners thereof, and a fixed shaft 906*c* fixed between the two side plates 906*a* at second corners thereof.

At top portions of the two side plates 906*a* of the supporting member 906, penetrating holes 906*d* are formed, through which the common shaft 905 penetrates. The center driven roller 903 of the smaller diameter is rotatably supported about the penetrating fixed shaft 906*c* of the supporting member 906. In addition, both end portions of a torsion spring 908 coiled around the common shaft 905 are in contact not only with the connecting plate portion 906*b* of the supporting member 906, but also with a fixed plate portion 703 inside the feeding mechanism housing 701. With a biasing force applied by the torsion spring 908, the center driven roller 903 is elastically pressed against a peripheral surface of a center drive roller 901, which faces the driven roller 903, thereby forming a nip N3.

With the above-described configuration, the position of the nip N3 formed between the center driven roller 903 and the corresponding center drive roller 901 is offset downstream in the feeding direction D1 with respect to positions of nips N2 formed between the other four driven rollers 902 and the corresponding four drive rollers 901. The amount of offset between the nip N3 and the nips N2 is 1 to 5 mm, for example.

As shown in FIG. 5, a plurality of coil springs 73 elastically presses second registration rollers 72 (upper side) to first registration rollers 71 (lower side) of pairs of registration rollers 70. The coil springs 73 are provided between the cover member 702 and a shaft 74 that rotatably supports the second registration rollers 72.

In the document feeding mechanism 44 of the document feeding device 700 thus configured, a document G fed from the feeding roller unit 40 is sequentially conveyed to the pairs of registration rollers 70, to the pair of first feeding rollers 90, and then to the CIS roller 91, along the feeding path L10 for reading a document toward the first document reading point J1. Upon the document G passing the first document reading position J1, an image on the back face of the document G is read by the first reading unit 201A.

Thereafter, while the image on the back face thereof is read, the document G is conveyed from the CIS roller 91 to the pairs of second feeding rollers 92, along the feeding path L10 for reading a document toward the second document reading point J2. Upon the document G passing the second document reading position J2, an image on the front face of the document G is read by the second reading unit 201B.

After the image on the back face of the document G is read at the first document reading point J1 and the image on the front face of the document G is read at the second document reading point J2, the document G is conveyed along the feeding path L11 for discharging a document from the pair of third feeding rollers 93 to the pair of discharging rollers 94. Subsequently, the document G is conveyed to the document collecting portion 720 and discharged to the document discharging space K.

During the abovementioned feeding operation and reading operation of the document G, the position of the nip N3 formed by the center driven roller 903, among the five driven rollers 902, 903 of the pair of first feeding rollers 90 that feed the document G to the first document reading point J1, is offset downstream in the feeding direction D1 with respect to the position of the nips N2 formed by the four other driven rollers 902. In other words, the nip N3 is configured to be not in line with the nips N2 along the direction D2 orthogonal to the feeding direction D1.

Given this, when a rear end of the document G in the feeding direction is released from the pair of first feeding rollers 90, an entirety of the rear end is not simultaneously or substantially simultaneously released, but rather is released with a time lag corresponding to the amount of offset between the nips N2 and the nip N3. This can reduce a change (reduction) in the feeding load upon release of the rear end of the document G from the nips N2, N3 and a resulting temporary change (acceleration) in the feeding speed of the document G. As a result, it is possible to feed the document G at a constant speed so that it is read properly.

The present embodiment provides the following effects, for example.

In the document feeding device 700 of the present embodiment, the pair of first feeding rollers 90, which is positioned more upstream than the first document reading point J1 in the feeding direction D1, include the plurality (five) of drive rollers 901 and the plurality (five) of driven rollers 902 and 903. The drive rollers 901 are arranged at the predetermined intervals in the direction D2 orthogonal to the feeding direction D1. The driven rollers 902 and 903 are arranged to face the drive rollers 901 and form the plurality of nips N2, N3 with the drive rollers 901. In addition, the plurality of driven rollers 902, 903 is supported by one common shaft 905 extending in the direction D2 orthogonal to the feeding direction D1. The position of the nip N3 formed by the center driven roller 903, among the plurality of driven rollers 902, 903, is offset more downstream in the feeding direction D1 with respect to the positions of the nips N2 formed by other driven rollers 902.

Accordingly, the present embodiment does not require the rotational shafts and the supporting member thereof to be individually and independently provided, differing from the prior art. In the prior art, the rotational shafts of the plurality of driven rollers 902 and the center driven roller 903 have been arranged offset with respect to each other along the feeding direction D1, so that the nips N2, N3 have been formed nonlinearly along the direction D2 orthogonal to the feeding direction D1. In addition, it is possible to support all of the driven rollers 902, 903 at the predetermined positions by employing one common shaft 905 and one supporting member supporting the common shaft 905. This can reduce the number of components in the apparatus, simplify a structure thereof, facilitate assembly thereof, and reduce manufacturing cost thereof.

Furthermore, it is not necessary to individually assemble the plurality of driven rollers 902, 903. It is sufficient only to assemble the one common shaft 905 into these components. This can increase the positional accuracy of the driven rollers 902, 903 and the distance (dimensional) accuracy between these rollers. It is possible to perform stable feeding of a document by suppressing the feeding load through the offset between the nips N2 and nip N3 in addition to proper feeding operation by the driven rollers 902, 903.

In addition, in the present embodiment, the position of the nip N3 formed by the center driven roller 903 arranged at the central position in the direction D2 orthogonal to the feeding direction D1, among the plurality of driven rollers 902, 903, is offset more downstream in the feeding direction D1 than the positions of the nips N2 formed by the other driven rollers 902.

Therefore, the central portion in the width direction of the rear end of the document G in the feeding direction D1 is released from the center driven roller 903, with a time delay with respect to the both end portions in the width direction. Accordingly, since an excessive rotational moment is not applied to the document G, it is possible to cause the document G to be released straight from the driven rollers, thereby further stabilizing the feeding of the document G.

A preferred embodiment of the present disclosure has been described above. However, the present disclosure is not limited thereto and can be carried out in various modes.

The copy machine 1 is exemplified in the present embodiment as an image forming device. However, the present disclosure is not limited thereto and can be a color copy machine, a printer, a facsimile machine, and a multi-functional appliance having functions thereof, for example.

The offset driven roller, of which the position of the nip N3 is offset, is not limited to the center driven roller located at the central position in the direction D2 orthogonal to the feeding direction D1. It may be one or more driven rollers not located at the central position in the direction D2 orthogonal to the feeding direction D1.

In addition, in the present embodiment, the five drive rollers 901 and five driven rollers 902, 903 are provided at the predetermined intervals in the direction D2 orthogonal to the feeding direction. However, the present disclosure is not limited thereto. It may be that the number of the driven rollers 902, 903 is an arbitrary plural number, two or more. The drive roller 901 may be composed of one or more rollers. The drive roller 901 has a length corresponding to the plurality of driven rollers and is disposed at positions corresponding to them.

In the present embodiment, the position of the nip N3 formed by the center driven roller 903 is offset more downstream in the feeding direction D1 with respect to the position of the nips N2 formed by the other driven rollers 902. However, the present disclosure is not limited thereto and the position of the nip N3 may be offset more upstream in the feeding direction D1. The amount of an offset is 1 to 5 mm, for example.

In addition, in the present embodiment, the document reader 201 has the first reading unit 201A and the second reading unit 201B, which read images on the front and back faces of the document G sequentially while the document G is being fed in one direction without turning over the document G, disposed upstream and downstream in the feeding direction D1. However, the present disclosure is not limited thereto. It may be that one document reader is configured to read images on front and back faces of a document G by turning it over.

What is claimed is:

1. A document feeding device comprising:

a document reader configured to read a document fed in a feeding direction;

a drive roller disposed upstream of the document reader in the feeding direction;

a plurality of driven rollers disposed opposite to the drive roller to form nips therebetween, a supporting member configured to be rotatably supported about a penetrating common shaft extending in a direction of a width of the document orthogonal to the feeding direction; and a biasing member configured to bias the supporting member, wherein the plurality of driven rollers are supported by the common shaft, a position of at least one nip formed by at least one of the plurality of driven rollers is offset downstream or upstream of other nips formed by other driven rollers, the at least one offset driven roller is rotatably supported about an axis line thereof by the supporting member and rotatably supported about the common shaft via the supporting member, and the biasing member biases the supporting member towards the drive roller, such that the at least one offset driven roller comes in contact with the drive roller, wherein the at least one offset driven roller has a diameter smaller than the other driven rollers.

2. The document feeding device according to claim 1, wherein the other driven rollers are supported concentrically and rotatably about the penetrating common shaft.

3. The document feeding device according to claim 2, wherein the at least one offset driven roller is a driven roller that is disposed at a central position of the width of the document, among the plurality of driven rollers.

4. The document feeding device according to claim 3, wherein the document reader includes two reading units configured to respectively read front and back faces of the document without turning over.

5. The document feeding device according to claim 2, wherein the document reader includes two reading units configured to respectively read front and back faces of the document without turning over.

6. The document feeding device according to claim 1, wherein the at least one offset driven roller is a driven roller that is disposed at a central position of the width of the document, among the plurality of driven rollers.

7. The document feeding device according to claim 6, wherein the document reader includes two reading units configured to respectively read front and back faces of the document without turning over.

8. The document feeding device according to claim 1, wherein the document reader includes two reading units configured to respectively read front and back faces of the document without turning over.

9. An image forming apparatus comprising:

the document feeding device according to claim 1; and an image forming unit configured to form an image on an image recording medium shaped like a sheet based on image information acquired by the document reader in reading the document.

10. A document feeding device comprising:

a document reader configured to read a document fed in a feeding direction;

a drive roller disposed upstream of the document reader in the feeding direction; and a plurality of driven rollers disposed opposite to and in direct contact with the drive roller to form nips therebetween, wherein the plurality of driven rollers is supported by a common shaft extending in a direction of a width of the document orthogonal to the feeding direction, a position of at least one nip formed by at least one of the plurality of driven rollers is offset downstream or upstream of other nips formed by other driven rollers, the drive roller and each of the plurality of driven rollers are configured to rotate in reverse directions with each other, and the at least one offset driven roller has a diameter smaller than the other driven rollers.

11. An image forming apparatus comprising:

the document feeding device according to claim 10; and an image forming unit configured to form an image on an image recording medium shaped like a sheet based on image information acquired by the document reader in reading the document.

12. The document feeding device according to claim 10, further comprising:

a supporting member configured to be rotatably supported about the penetrating common shaft; and a biasing member configured to bias the supporting member, wherein the at least one offset driven roller is rotatably supported about an axis line thereof by the supporting member and rotatably supported about the common shaft via the supporting member, and the biasing member biases the supporting member towards the drive roller, such that the at least one offset driven roller comes in contact with the drive roller.

13. The document feeding device according to claim 10, wherein the other driven rollers are supported concentrically and rotatably about the penetrating common shaft.

14. The document feeding device according to claim 10, wherein the at least one offset driven roller is a driven roller that is disposed at a central position of a width of the document, among the plurality of driven rollers.

15. The document feeding device according to claim 10, wherein the document reader includes two reading units configured to respectively read front and back faces of the document without turning over.

* * * * *